US010709909B2

(12) United States Patent
Majala et al.

(10) Patent No.: US 10,709,909 B2
(45) **Date of Patent: *Jul. 14, 2020**

(54) NOZZLE FOR RETRACTABLE FALL ARREST

(71) Applicant: Reliance Industries, LLC, Wheat Ridge, CO (US)

(72) Inventors: Jonathan Majala, Wheat Ridge, CO (US); Gary Choate, Lakewood, CO (US)

(73) Assignee: RELIANCE INDUSTRIES, LLC, Wheat Ridge, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/952,430

(22) Filed: Apr. 13, 2018

(65) Prior Publication Data

US 2018/0229058 A1 Aug. 16, 2018

Related U.S. Application Data

(62) Division of application No. 14/995,694, filed on Jan. 14, 2016, now Pat. No. 9,968,804.

(51) Int. Cl.
*A62B 1/14* (2006.01)
*A62B 35/00* (2006.01)

(52) U.S. Cl.
CPC ..... *A62B 1/14* (2013.01); *A62B 35/0093* (2013.01)

(58) Field of Classification Search
CPC .... A62B 1/14; A62B 1/06; A62B 1/08; A62B 1/10; A62B 1/12; A62B 35/0043; A62B 35/0093; D01H 1/115; D01H 4/02; D01H 4/34; D01H 7/92
USPC ..... 182/70, 73; 277/644, 628, 647; 222/575; 239/589, 592, 594, 595, 596, 239/597, 599, 601
See application file for complete search history.

(56) References Cited

U.S. PATENT DOCUMENTS 327,111 A * 9/1885 Robinson ..... A62B 1/14 182/193
2,546,202 A * 3/1951 Trouin ..... A62B 35/0093 242/381.6
2,896,912 A * 7/1959 Faugier ..... B66D 5/04 242/381.6
2,943,373 A * 7/1960 Rapata ..... F16B 21/075 24/662
2,990,131 A * 6/1961 Carlsson ..... A62B 35/0093 242/381.5

(Continued)

*Primary Examiner* — Katherine W Mitchell
*Assistant Examiner* — Shiref M Mekhaeil
(74) *Attorney, Agent, or Firm* — Sandberg Phoenix & von Gontard, P.C.

(57) ABSTRACT

A nozzle for a retractable fall arrest defines a passage extending through the nozzle between a top surface and a bottom surface of the nozzle through which a retractable cable or lifeline can extend. The passage has a passage axis, an elongate entrance, and an elongate exit. The passage defines a constricted portion having opposed end sections and a middle section. The end sections of the constricted portion define a width greater than a width of the middle section of the constricted portion, and the width of the middle section of the constricted portion is less than a width of at least one of the entrance and exit to the passage. A perimeter of the passage defines a plane which intersects said passage axis at an angle greater than zero.

15 Claims, 12 Drawing Sheets

(56) References Cited

U.S. PATENT DOCUMENTS 3,662,583 A * 5/1972 Moore, Sr. ..... B21D 41/00 72/370.08
3,760,910 A * 9/1973 Koshihara ..... A62B 35/0093 188/180
3,879,016 A * 4/1975 Kankkunen ..... A62B 1/10 242/396
3,907,256 A * 9/1975 Kankkunen ..... A62B 1/12 242/381
4,076,082 A * 2/1978 Baum ..... E21B 7/14 175/14
4,198,033 A * 4/1980 de la Messuziere ..... A62B 35/0093 182/241
4,511,123 A * 4/1985 Ostrobrod ..... A62B 35/0093 182/234
4,513,954 A * 4/1985 Cantamessa ..... B60G 7/00 267/141.3
4,846,313 A * 7/1989 Sharp ..... A62B 35/0093 188/187
4,924,038 A * 5/1990 Klosin ..... H02G 15/013 174/135
5,094,405 A * 3/1992 Brum ..... B64D 3/02 114/247
5,186,289 A * 2/1993 Wolner ..... A62B 1/12 182/232
5,210,374 A * 5/1993 Channell ..... G02B 6/4444 174/38
5,343,976 A * 9/1994 Ostrobrod ..... A62B 1/06 182/237
5,351,905 A 10/1994 Feathers
5,351,906 A * 10/1994 Feathers ..... A62B 1/10 182/237
5,480,060 A * 1/1996 Blythe ..... A47K 10/421 206/389
5,722,612 A * 3/1998 Feathers ..... A62B 35/0093 192/103 C
5,771,993 A * 6/1998 Anderson ..... A62B 35/04 182/18
5,868,323 A * 2/1999 Cantor ..... B65D 47/0842 222/556
6,016,031 A * 1/2000 Lapatovich ..... H01J 61/12 220/2.1 R
6,394,369 B2 * 5/2002 Goenka ..... B05B 1/042 239/589
6,474,442 B1 * 11/2002 Atkinson ..... A62B 35/0087 182/36
6,486,379 B1 * 11/2002 Chen ..... A61F 13/4704 604/378
6,810,997 B2 * 11/2004 Schreiber ..... A62B 1/10 182/233
7,136,612 B2 * 11/2006 Nooyens ..... G03G 15/0283 399/170
7,558,394 B2 * 7/2009 Tilson ..... H04R 25/654 381/312
7,780,146 B2 * 8/2010 Casebolt ..... A62B 1/10 254/346
8,033,968 B2 * 10/2011 Chen ..... A63B 21/00047 482/141
8,052,080 B2 * 11/2011 Liang ..... B66D 5/16 242/371
8,408,193 B2 * 4/2013 McPherson ..... F41B 5/14 124/25.6
8,469,149 B2 * 6/2013 Meillet ..... A62B 35/0093 182/230
8,689,719 B1 * 4/2014 Roberts ..... B63B 21/00 114/230.23
8,950,551 B2 * 2/2015 Jones ..... A62B 35/0093 182/231
8,991,376 B2 * 3/2015 McPherson ..... F41B 5/10 124/1
2001/0000583 A1 * 5/2001 Ohman ..... B29C 66/452 156/295
2002/0071738 A1 * 6/2002 Choate ..... A62B 35/0068 411/348
2007/0261915 A1 * 11/2007 Auston ..... A62B 35/0056 182/11
2010/0116922 A1 * 5/2010 Choate ..... A62B 35/04 242/384.7
2012/0118670 A1 * 5/2012 Olson ..... A62B 1/10 182/232
2012/0145481 A1 * 6/2012 Jones ..... A62B 35/0093 182/231
2014/0061251 A1 * 3/2014 Bloc ..... B05B 11/3047 222/321.7
2016/0175958 A1 * 6/2016 Mochizuki ..... B23K 1/018 228/20.1
2016/0310767 A1 * 10/2016 Resch ..... A62B 1/14
2016/0346572 A1 * 12/2016 Choate ..... A62B 35/0093

* cited by examiner

NOZZLE FOR RETRACTABLE FALL ARREST

CROSS-REFERENCE TO RELATED APPLICATIONS

This application is a divisional of co-pending U.S. application Ser. No. 14/995,694, filed Jan. 14, 2016, which is entitled "Nozzle for Retractable Fall Arrest" and which is incorporated herein by reference.

STATEMENT REGARDING FEDERALLY SPONSORED RESEARCH OR DEVELOPMENT

Not Applicable.

BACKGROUND OF THE INVENTION

This application relates to retractable fall arrest units or blocks, and, in particular to an improved nozzle for the retractable fall arrest.

Retractable fall arrest units have been used for many years and range in size from small (6 ft.) units to large (175 ft.) units. The purpose of a retractable fall arrest unit is to allow workers who must work on the leading edge of elevated surfaces (or other areas where falls are of concern) to have a means to attach to an anchorage that will arrest their motion in case of an accidental fall. These retractables are usually equipped with a 3/16" wire rope cable or a 1" webbing lanyard of sufficient strength to withstand the forces from a fall (currently, at least 3600 lbs. of anchorage strength). The retractables are equipped with shock absorbers that will limit the forces of a falling worker to 900 lbs. or less during a fall arrest. These shock absorbers may comprise an internal mechanical clutch type or an external rip-stop type made of webbing.

A retractable fall arrest unit with a prior art nozzle is shown in FIG. 1. As seen, the retractable fall arrest unit 10 includes a housing 12 with an axle 14 that supports a cable drum 16, a braking assembly 18, and a spring assembly 20. A cable 22 is wound on the drum 16 and exits the housing through a nozzle 24. As is known, the housing can be secured to an anchor and the cable can be attached to a harness worn by a worker. As the worker moves about, the cable 22 will be pulled from and retracted into the housing as the worker's distance from the housing varies. Should the worker fall, the brake assembly 18 will slow and stop the worker's fall to reduce injury to the worker.

The standard or prior art nozzle 24 is a generally circular nozzle having a generally cylindrical outer surface and an inner surface which is generally hour-glass shaped. The inner surface thus defines an upper or inner portion 24*a* (within the retractable housing) which is generally conical and a lower or outer portion 24*b*, which is also generally conical. The two conical portions are joined at their apexes by a through bore 24*c* through which the cable extends. With this "standard" nozzle configuration, the cable has a tendency to wrap in the center of the drum due to the short fleet angle of a side retractable unit and will not fill all the way to the sides of the drum. This results in a build-up of cable in the center of the drum which can cause the cable to rub on the inner diameter of the housing and can prevent the full cable length from being able to retract on the drum even though the drum was large enough in depth and width to hold all the cable. It would be beneficial to provide a nozzle which reduced the possibility of this from occurring.

BRIEF SUMMARY OF THE INVENTION

Briefly stated, a nozzle is provided for a retractable fall arrest unit. The fall arrest unit comprises a housing, a cable drum mounted in the housing to rotate relative to the housing, and a cable wound about the cable drum. The cable extends through the nozzle to exit the housing to be unwound from, and rewound on, the cable drum.

The nozzle defines a passage extending through the nozzle between a top surface and a bottom surface of the nozzle through which a cable can pass. The passage has a passage axis, an elongate entrance, and an elongate exit. The passage defines a constricted portion having opposed end sections and a middle section. A horizontal cross-section of the constricted section extends substantially perpendicular to the passage axis. The end sections of the constricted portion define a width greater than a width of the middle section of the constricted portion, and the width of the middle section of the constricted portion is less than a width of at least one of the entrance and exit to the passage. A perimeter of the passage defines a plane which intersects said passage axis at an angle greater than zero.

In accordance with one aspect of the nozzle, edges of the end sections of the elongate opening define a substantially semicircular arc and edges of the middle section of the opening define an inwardly directed arc.

In accordance with another aspect of the nozzle, the entrance and exit to the passage at the top and bottom of the nozzle are generally in the shape of a flattened oval or elongated circle. That is, the passage, in top and bottom plan view, is generally a flattened oval or elongated circle.

In accordance with another aspect of the nozzle, the constricted portion is between the entrance and exit to the nozzle.

In accordance with a further aspect of the nozzle, at least the upper portion or upper edge of the constricted portion is made from a material which will withstand frictional forces of the cable when the cable slides across said upper surface to prevent cold welding of the cable to the nozzle.

In one embodiment, the nozzle is a unitary, one-piece nozzle comprised of a hollow body having an upper surface, a bottom surface, a side surface, and the elongate passage extending between the top and bottom surfaces. The body has an inwardly directed peripheral flange within the passage which divides the body passage into an upper portion and a lower portion. The flange defines the elongate opening.

In accordance with an aspect of this nozzle, the upper portion of the passage includes a side wall, which can be generally straight. This side wall can be recessed relative to an inner edge of the top surface of the body.

In accordance with an aspect of the nozzle, the lower portion of the passage is defined by a wall which slopes from an edge of the elongate slot to a bottom inner edge of the passage.

In accordance with a further aspect of the nozzle, junctions between the top and bottom surfaces and the passage are curved or radiused, to present a continuous and substantially smooth surface to the cable which may contact the junction between the body and the passage.

In another embodiment, the nozzle is a two-part nozzle and comprises a nozzle body and a separate insert which is received in the body. In this two-part nozzle, the insert defines the elongate opening.

In accordance with an aspect of this nozzle, the nozzle insert has in inner surface which defines the elongate nozzle opening. The inner surface comprises a material which will withstand frictional forces of the cable when the cable slides across the upper surface to prevent cold welding of the cable to the nozzle.

In accordance with an aspect of the two-part nozzle, the nozzle body comprises an upper portion defined in part by an upper inner wall, a central portion defined in part by a central inner wall, and a lower portion defined in part by a lower wall, a first floor between the upper portion and the central portion, and a second floor between the central portion and the lower portion. The central portion wall is set inwardly from the upper portion wall; and the lower portion wall slopes outwardly and downwardly from an inner edge of the second floor to a bottom of the nozzle body.

In accordance with an aspect of the two-part nozzle, the nozzle insert comprises an upper outer wall shaped complementarily to the nozzle body upper inner wall, a lower outer wall shaped complementarily to the nozzle body central wall, a shoulder between the upper and lower outer walls, and the insert inner surface. The shoulder is sized and shaped to sit on the nozzle body first floor. The inner surface extends from a top of the insert to a bottom of the insert. The nozzle insert lower wall has a length corresponding to the height of the nozzle body central inner surface, such that the bottom surface of the insert rests on the second floor of the nozzle body.

In accordance with an aspect of the nozzle, the nozzle body comprises a lip extending inwardly from a top of the upper inner surface over the first floor. The insert upper outer wall has a height corresponding substantially to the height of the body upper inner surface, such that an upper portion of the insert is sandwiched between said body first floor and said body lip.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
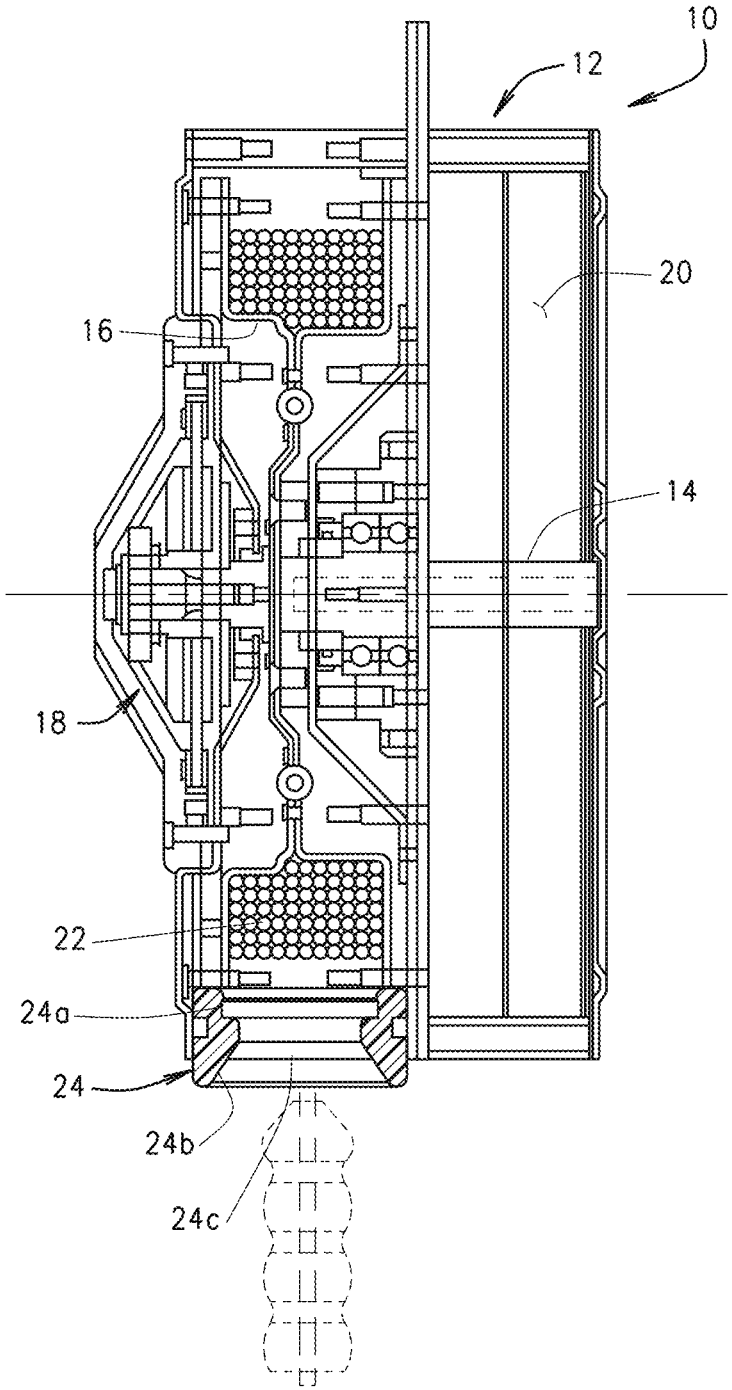
FIG. 1 is a cross-sectional view of a fall retractor fitted with a standard or prior art nozzle.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what is presently believed to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

The nozzles 210 and 310 described herein overcome the problem noted in the background. Referring initially to FIGS. 2-6B, a unitary one-piece nozzle 210 is shown. The nozzle 210 is oblong or in the shape of a flattened oval or elongated circle and has an outer wall 212 having two opposed generally flat sides joined by arced ends. The wall 212 is straight and generally parallel to a vertical, or Y-, axis, of the nozzle. A circumferential groove 214 is formed in the outer wall 212 and is sized to receive the edges of the nozzle retaining slot of the housing members, so that when the housing members are secured together, the nozzle will be secured in the housing.

Figure 4:
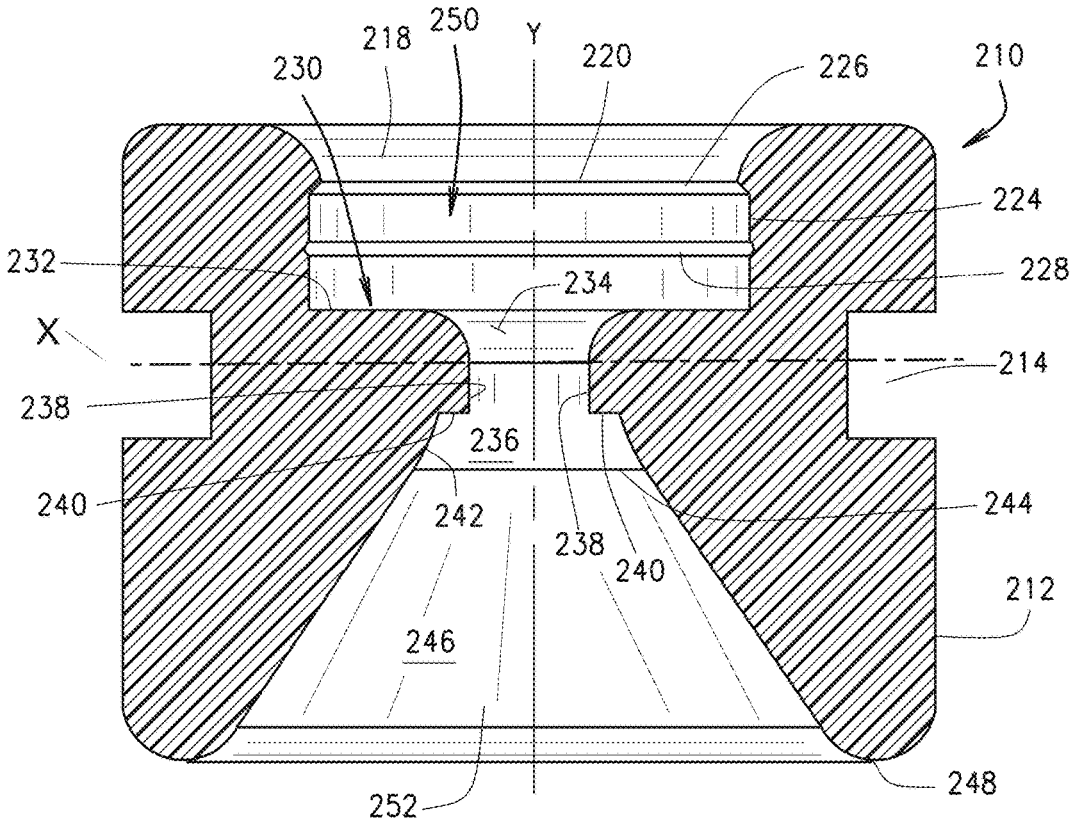
FIG. 4 is a cross-sectional view of the nozzle taken along line 4-4 of FIG. 2.
Figure 6A:
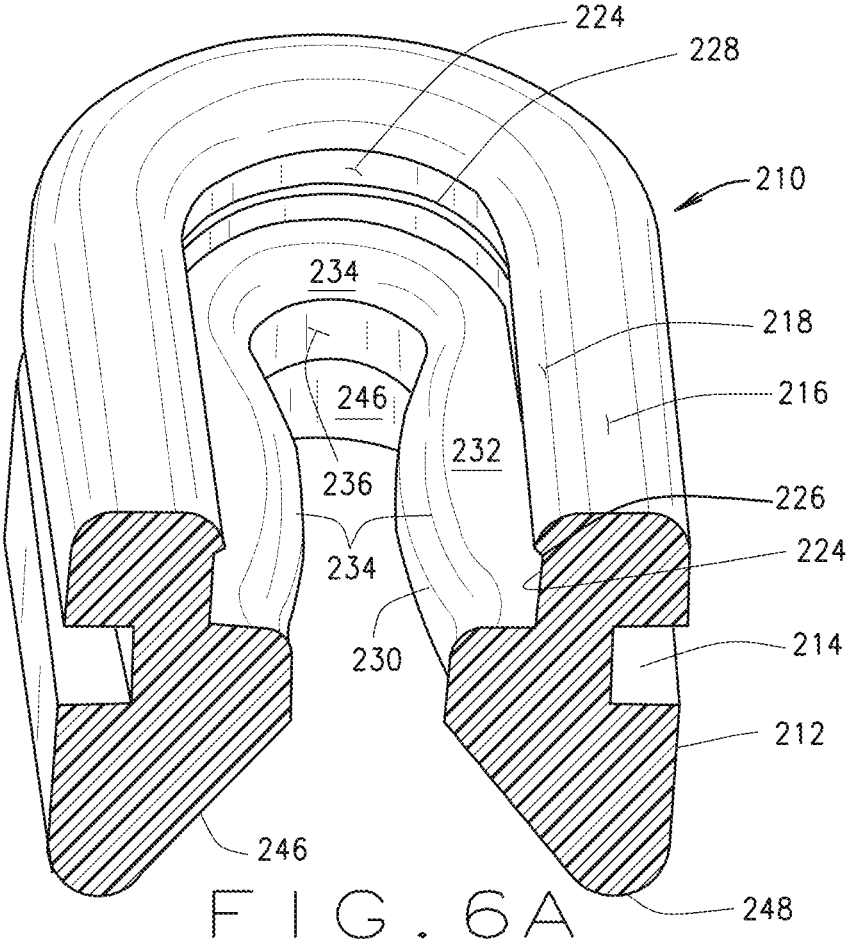
FIGS. 6A and 6B are top and bottom perspective cross-sectional views, respectively, taken along line 6-6 of FIG. 2.
Figure 6B:
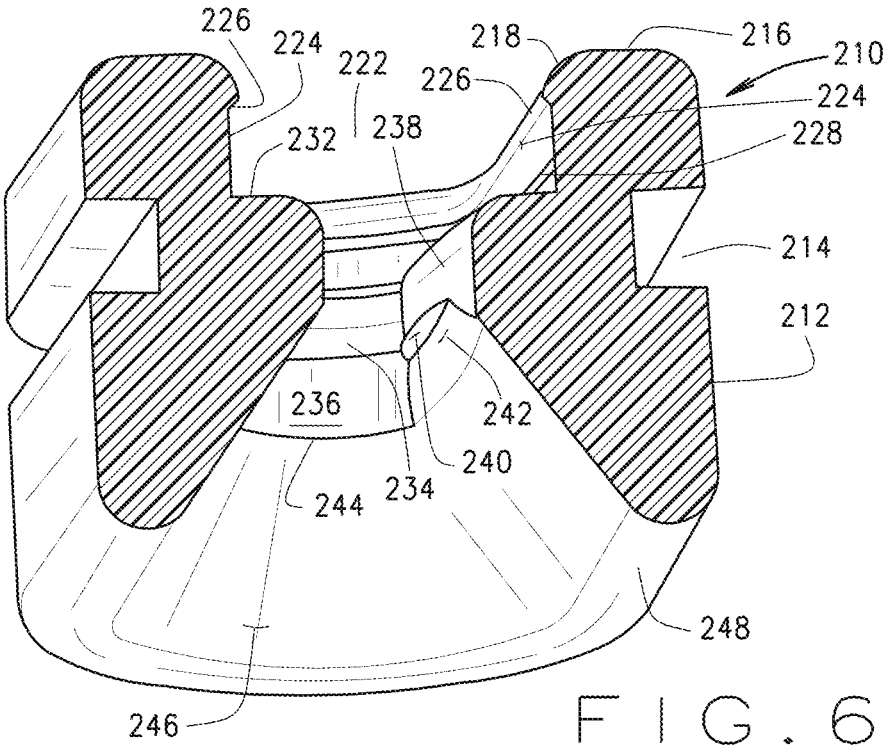
Figure 7:
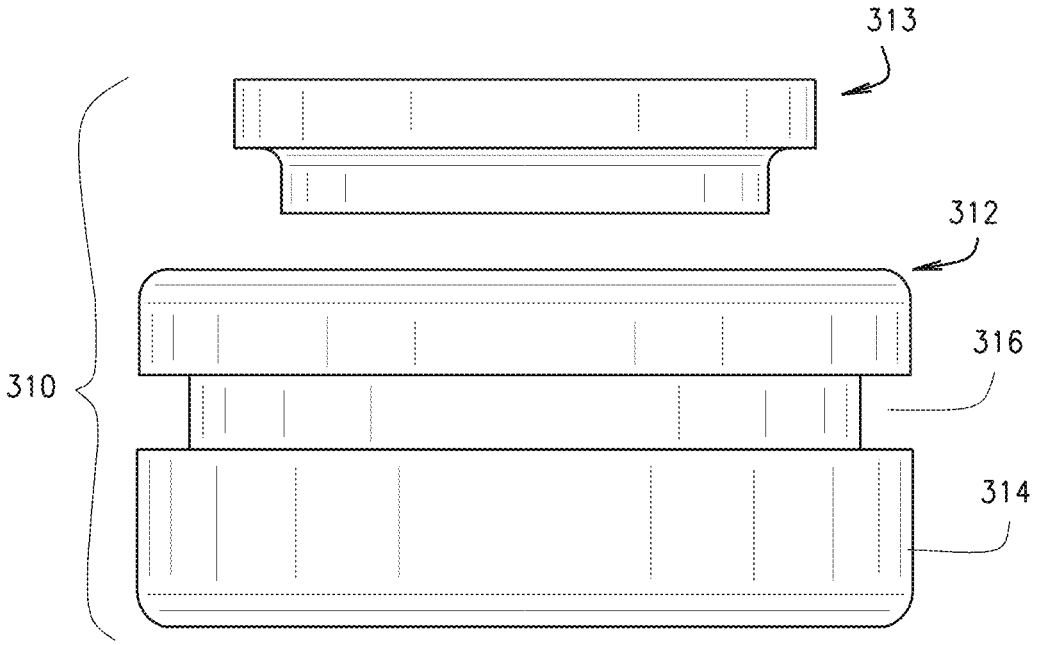
FIG. 7 is an exploded perspective view of a two-piece version of the nozzle comprising a nozzle body and a nozzle insert.
Figure 9:
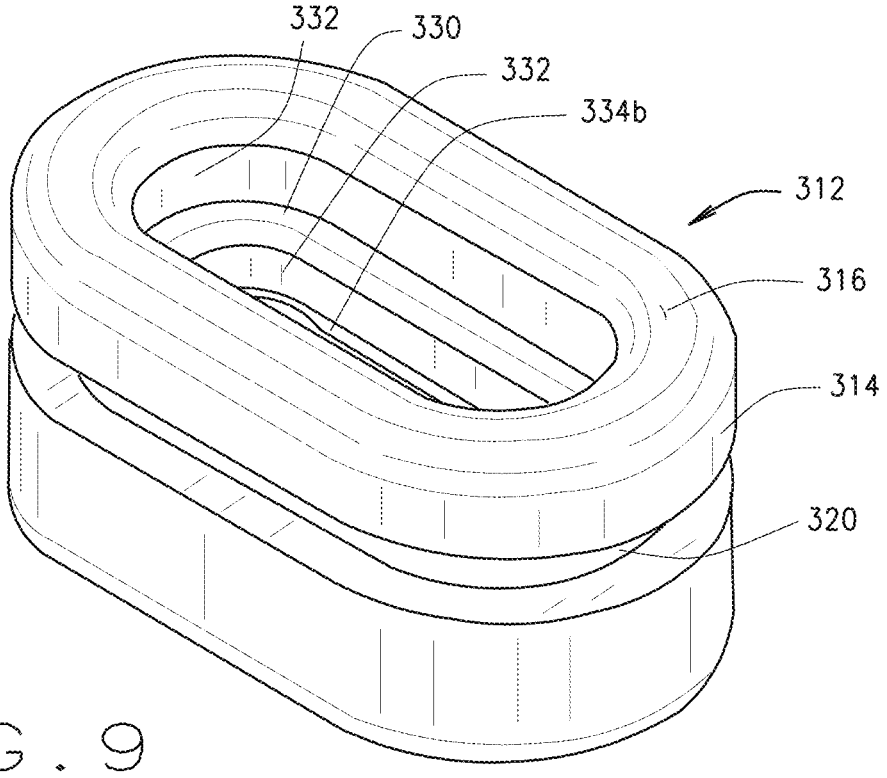
FIG. 9 is a top perspective view of the nozzle body.

The nozzle 210, which defines a nozzle passage having a passage axis, has an upper surface 216 which smoothly transitions from the outer wall 212, and which smoothly transitions to an inlet surface 218 having an inner edge 220. As seen, the top surface 216 is generally flat, with the junction to the outer wall 212 being radiused, and with the inlet surface 218 also being radiused. The inlet surface 218 and its inner edge 220 define an entrance 222 into the nozzle, the entrance having an oblong, flattened oval shape. An inner wall 224 depends from beneath the inlet surface 218 and is recessed relative to the inner edge 220 of the inlet surface 218. The inner wall 224 thus defines a shoulder 226 with the inlet surface. As seen in FIGS. 4, and 6A-B the shoulder 226 slopes slightly upwardly from the wall 224 to the edge 226 of the inlet surface 218. A groove 228 extends around the inner wall 224.

Figure 2:
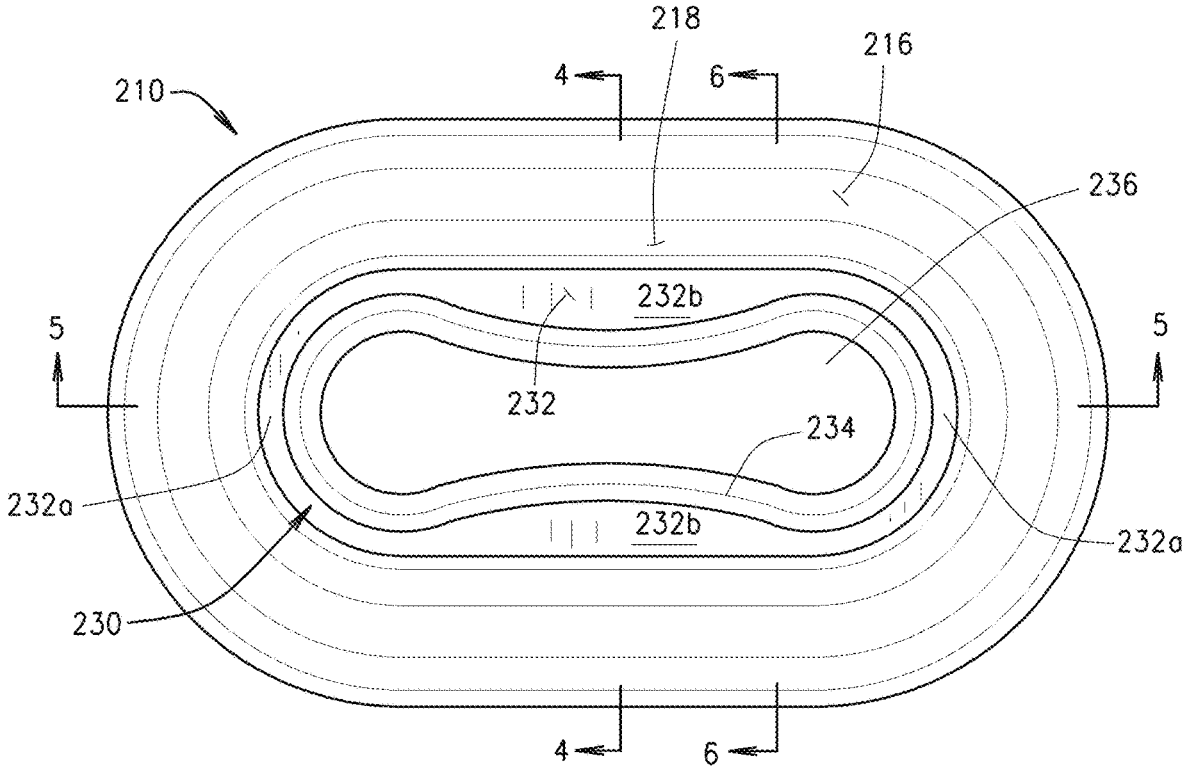
FIGS. 2 and 3 are top and bottom plan views, respectively, of a new nozzle for the retractable.
Figure 2A:
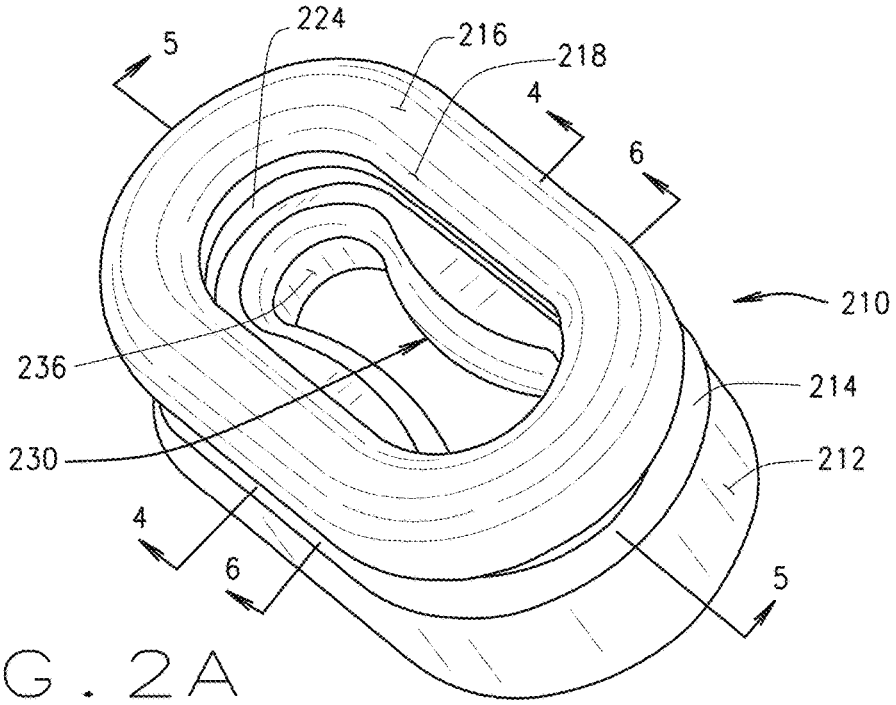
FIGS. 2A and 3A are top and bottom perspective views, respectively, of the nozzle.
Figure 3:
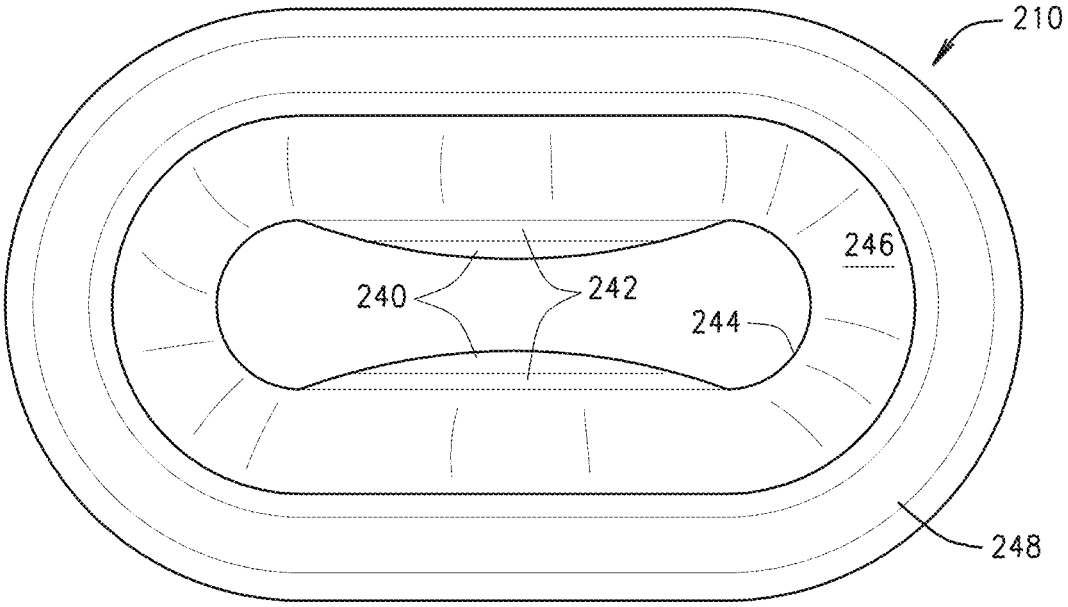
Figure 3A:
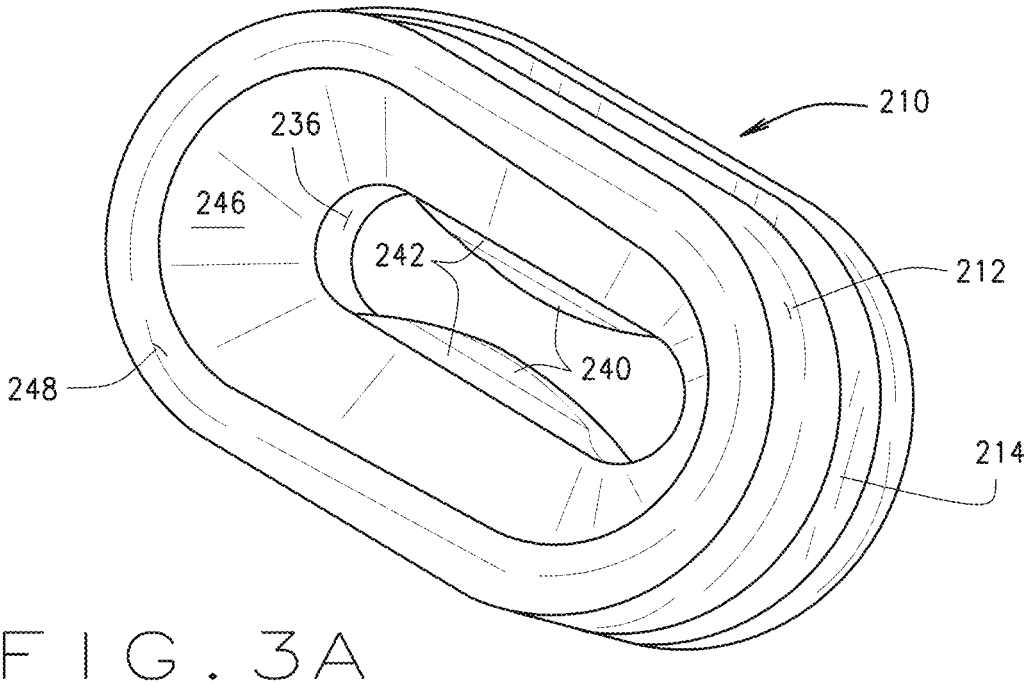
Figure 5:
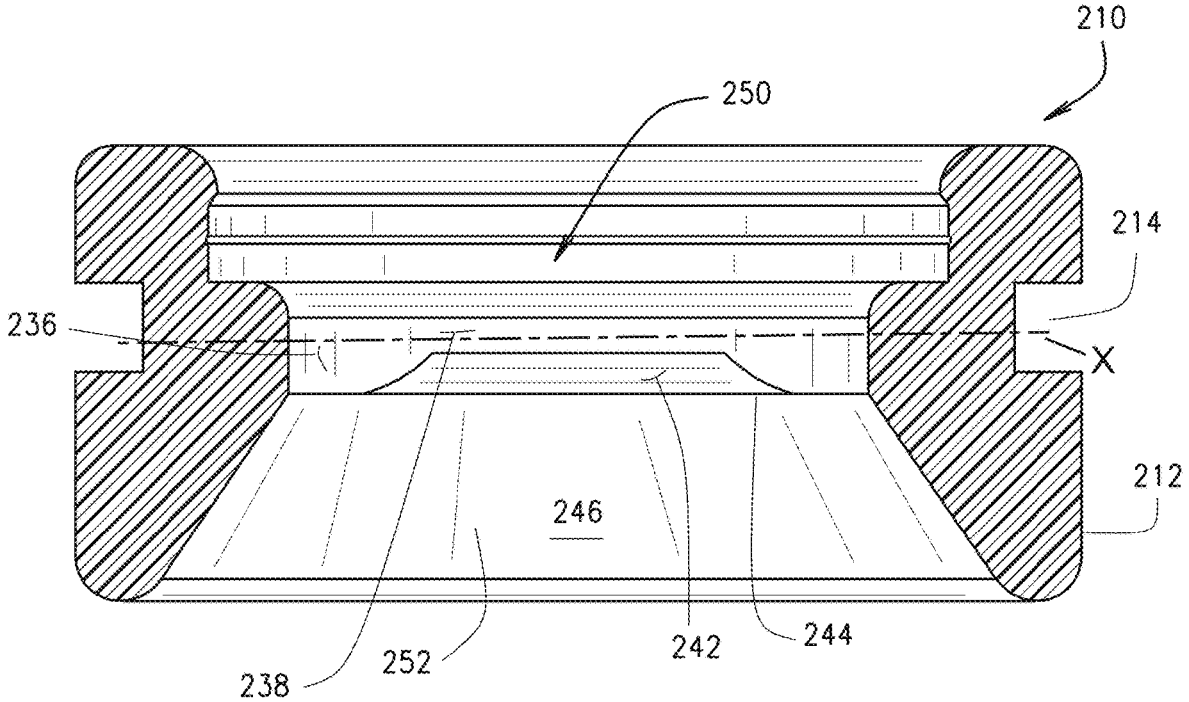
FIG. 5 is a cross-sectional view of the nozzle taken along line 5-5 of FIG. 2.

A circumferential ledge or flange 230 extends inwardly from the bottom of the inner wall 224. The flange 230 has an upper surface 232 which curves over to a radiused flange edge 234. The flange upper surface 232 is generally flat, and extends generally perpendicularly from the inner wall 224. The flange edge 234, as best seen in FIG. 2 defines a dog-bone shaped opening or constricted portion 236 through the nozzle passage. A cross-section (shown, for example by the line X in FIG. 4) of the constricted portion is substantially perpendicular to the passage axis. The upper surface 232 thus includes end sections 232*a* which form an arc of slightly more than 180° and side sections 230*b* which have an inwardly curving (concave) shape. The side sections 230*b* define an arc of about 30° to about 35°. At the end sections 232*a*, the flange 230 has generally straight flange walls 237. As best seen in FIGS. 5 and 6B, the side sections 232*a* have a flange wall 238 which is about one-half the height of the walls 237 at the ends of the flange. At the bottom of the side flange wall 238, the flange includes a flat under surface 240 which is generally parallel to the floor 232 and extends from the inner edge of the wall 238. Thereafter, a sloped surface 242 extends downwardly from the end of the under surface 240 a distance sufficient that the outer edge of the sloped surface 242 is even with the bottom of the flange end wall 237. The flange can also be described as having a cutout defined by the under surface 240 and the sloped surface 242. This cut-out can be eliminated, if desired, such that the edge 238 is of a constant depth around its circumference. The bottom of the flange end wall 237 and the bottom of the sloped surfaced 242, in combination, define an oblong, flattened oval shaped edge 244 (FIG. 3A).

The nozzle 210 includes a sloped bottom inner wall 246 that extends downwardly from the edge 244 to a bottom surface 248 of the nozzle 210. The bottom surface 248 is radiused, such that the nozzle has a smooth and radiused transition from the sloped inner wall 246 to the outer side wall 212.

As can be seen, the flange 230 divides the interior of the nozzle 210 into an upper portion 250 and a lower portion 252 (FIGS. 4 and 5) separated by the flange 230 which forms a dog-bone shaped opening between the upper and lower portions of the nozzle. The upper portion 250 has generally straight or vertical walls, as defined by the side wall 224 and a flat floor defined by the upper surface 232 of the flange 230, and which is generally perpendicular to the wall 226. The bottom portion 252 is defined by the sloped wall or surface 246. The entrance to the top and bottom sections from the top and bottom surfaces of the nozzle are smooth and radiused.

The nozzle of FIGS. 2-6B is shown as a single piece nozzle, and the nozzle can be formed from appropriate material, such as tool steel plated with nickel hardened sufficiently to prevent cold welding of the cable (which is typically made of steel) to the nozzle, to reduce the possibility of the cable breaking. For example, the steel plated nickel can be hardened to between a hardness of about 60 Rockwell C and about 65 Rockwell C. As an alternative, the single piece nozzle can be manufactured from an appropriate engineered material. Alternatively, the inner surface of the nozzle can be coated with such an engineered material, thereby allowing the nozzle itself to be formed from a softer material.

FIGS. 7-14B show an alternative, two-piece nozzle 310. The nozzle 310 comprises a body 312 and an insert 313. The body 312 can be made of, for example, plastic or rubber. The insert, on the other hand, can be made of a material, such as steel plated nickel, designed to withstand the friction and wear caused by the cable (which is typically made from hardened stainless steel) and which will avoid the cable becoming cold welded to the nozzle during a fall. Alternatively, the insert can be made from a softer material (such as a softer metal, or a plastic or rubber) and wherein at least the inner surface of the nozzle insert is coated with a sufficiently hard material, such as hardened nickel.

The nozzle body 312 is shown in FIGS. 9-11B. As seen, the nozzle body 312 is generally in the shape of an elongated circle or flattened oval. It has a generally straight side surface 314, a top surface 316, and a bottom surface 318. A circumferential groove 320 extends around the side surface 314 and is sized and shaped to cooperate with the nozzle opening in the retractable housing.

Figure 10A:
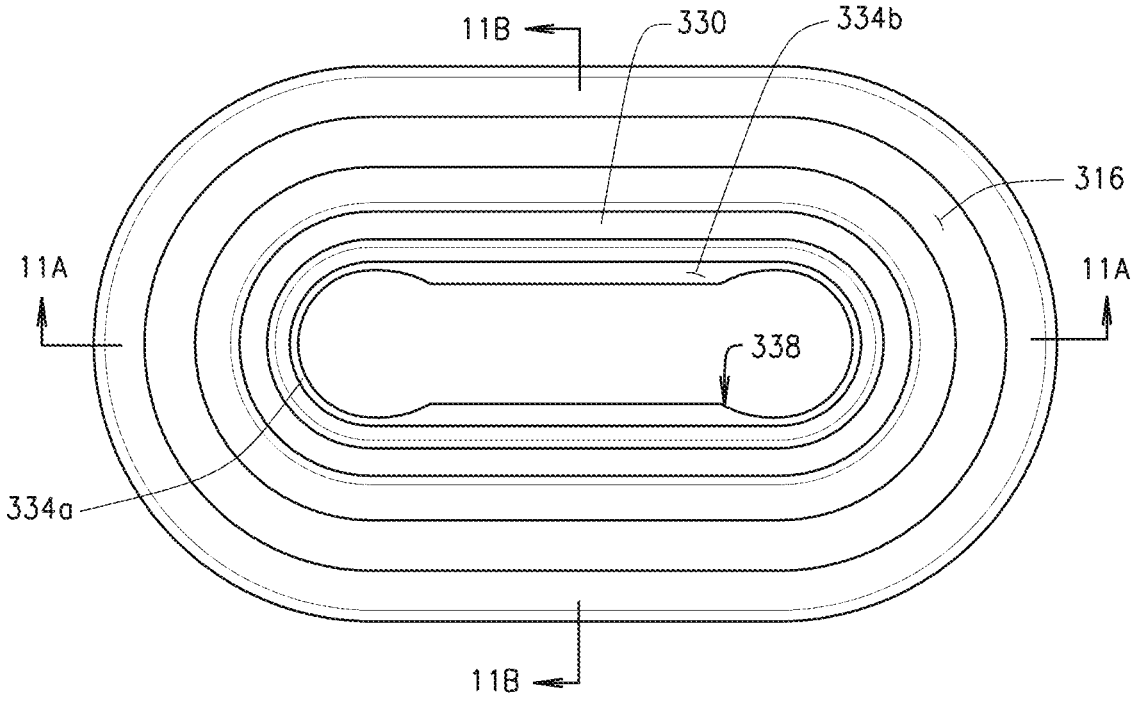
FIGS. 10A and 10B are top and bottom plan views, respectively, of the nozzle body.
Figure 10B:
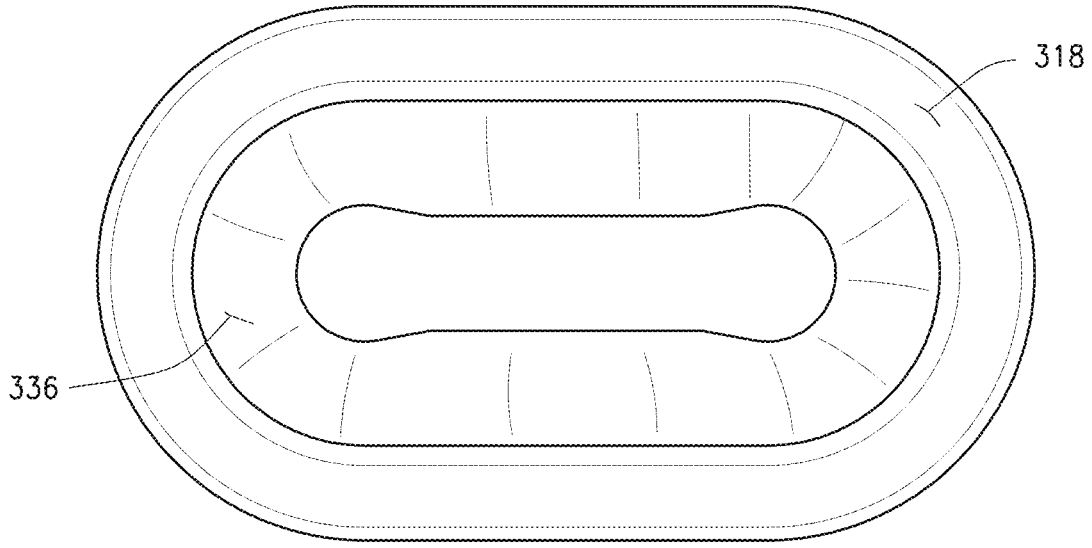
Figure 11A:
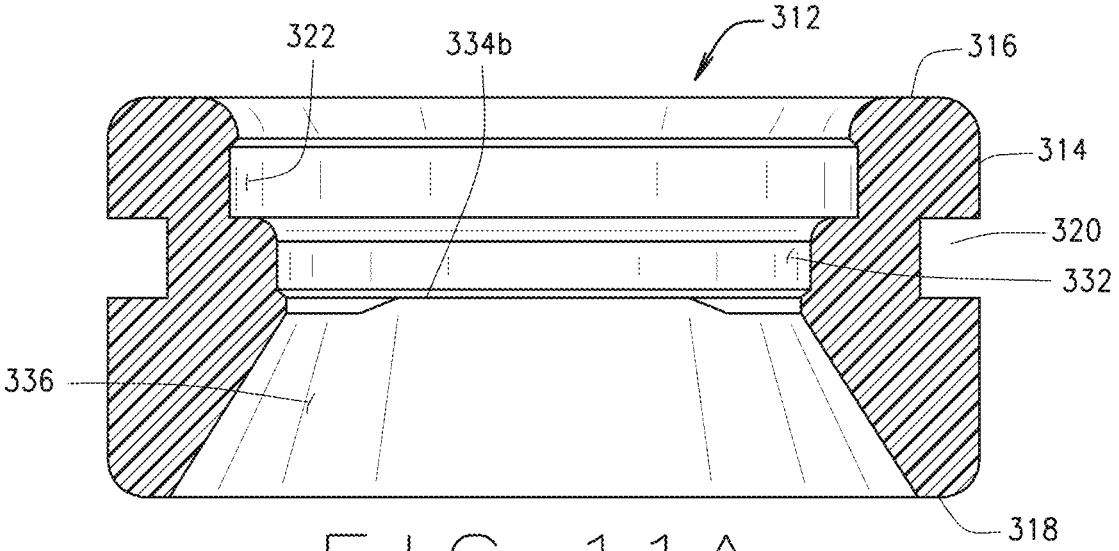
FIGS. 11A and 11B are cross-sectional views of the nozzle body taken along lines 11A-11A and 11B-11B, respectively, of FIG. 10A.
Figure 11B:
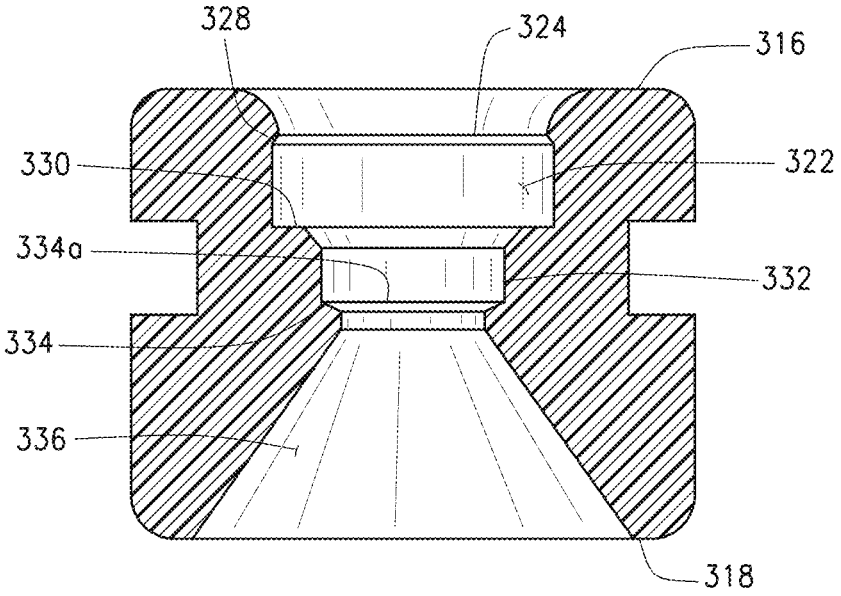

The nozzle body 312 is hollow and includes an upper inner surface 322 which is inset slightly from the inner edge 324 of the top surface 316, such that the inner surface defines an inwardly extending lip 328. As seen best in FIGS. 11A-B, the lip 328 slopes downwardly. A floor or ledge 330 extends inwardly from the bottom of the upper inner surface 322. As seen in FIG. 10A, the floor 330 is of substantially constant width, and has the same stretched circle or flattened oval shape of the body 312. A central inner surface 332 extends downwardly from the inner edge of the floor 330, and a lower floor 334 extends inwardly from the bottom of the central inner surface 332. The lower floor 334, as seen in FIG. 10A, includes semi-circular end portions 334*a* and elongate opposed middle portions 334*b*. The middle portions 334*b* are wider than the end portions 334*a*, such that the inner edge of the lower floor defines a dog-bone shaped opening or constricted portion through the passage of the nozzle. However, if desired, the lower floor 334 could have a constant annular width, such that the passage through the floor is in the shape of an elongated circle or flattened oval. A lower inner surface 336 extends downwardly and outwardly from the inner edge of the lower floor 334 to the inner edge of the bottom surface 318 of the nozzle body. The inner and outer edges of the top and bottom surfaces 316 and 318 are radiused to form a smooth transition between the outer wall 314 and the top and bottom surfaces and between the bottom surface 318 and the lower inner surface 336. Additionally, the inner edge of the upper floor 330 is radiused to form a smooth transition between the floor 330 and the central inner surface 332.

The insert 313 is shown in FIGS. 12A-14B. As seen, the insert 313 has vertical or straight upper and lower outer surfaces 340, 342. The lower outer surface 342 is inset relative to the upper outer surface 340, such that there is a shoulder 341 extending between the top of the lower outer surface 342 and the bottom of the upper outer surface 340. The outer surface of the insert, in vertical cross-section, is thus "⌐"-shaped. The upper and lower outer surfaces 340 and 342 are shaped complimentarily to the upper and central surfaces 322 and 332 of the nozzle body 312 and are sized to be received by the upper and central surfaces 322 and 332. The shoulder 341 is sized to rest on the floor 330 of the nozzle body 312.

Figure 12A:
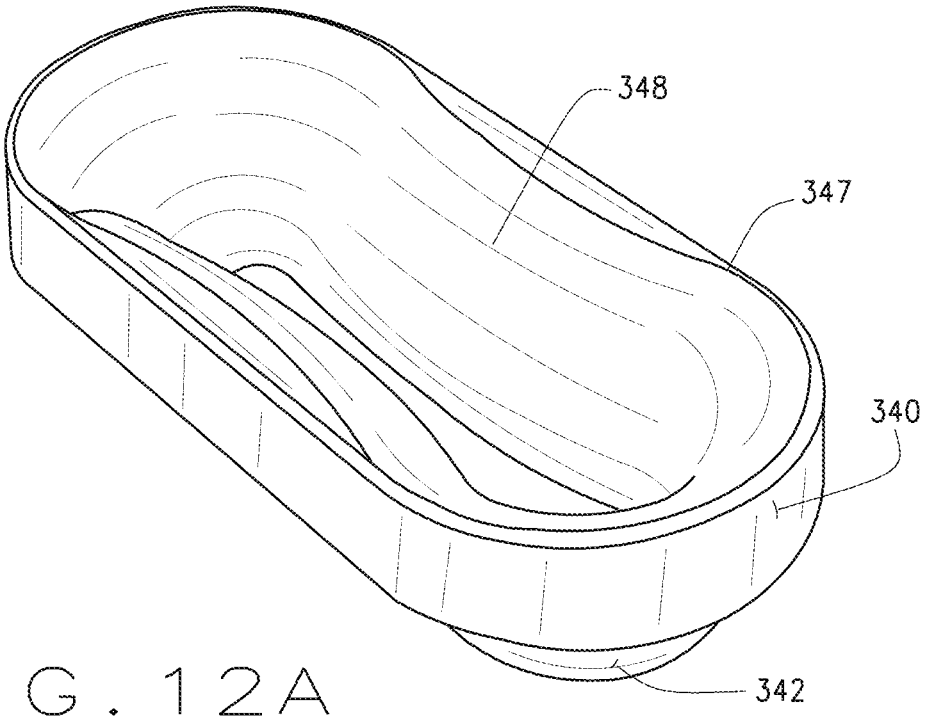
FIGS. 12A and 12B are top and bottom perspective views, respectively, of the nozzle insert.
Figure 12B:
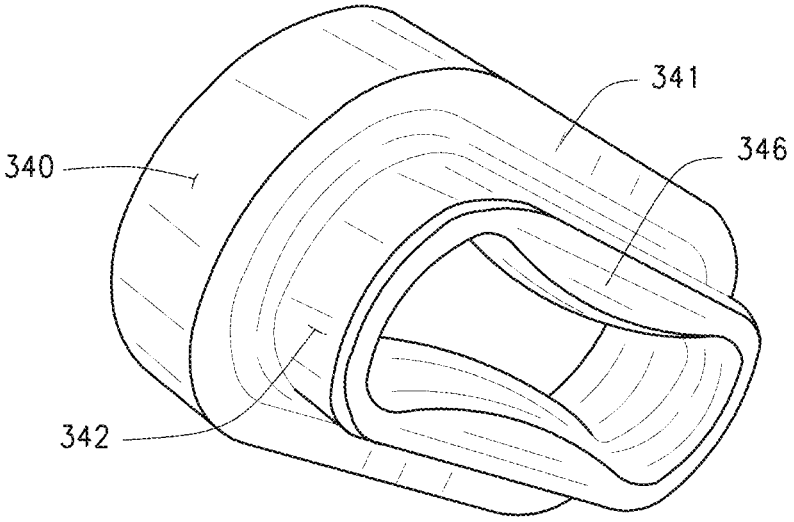
Figure 13A:
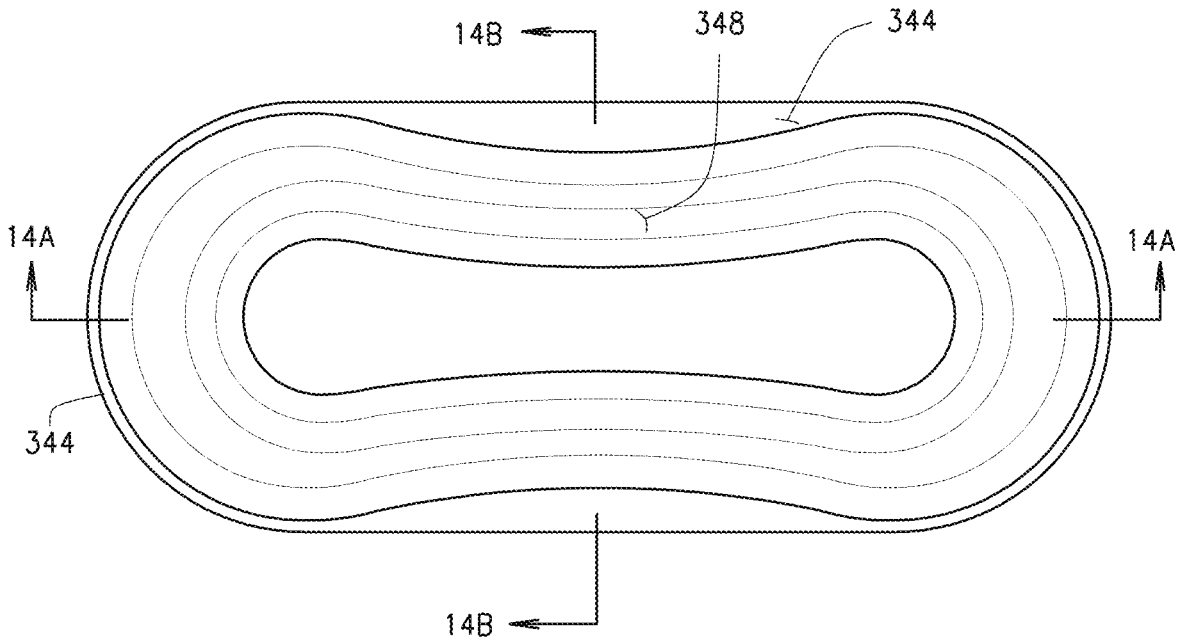
FIGS. 13A and 13B are top and bottom plan views, respectively, of the nozzle insert.
Figure 13B:
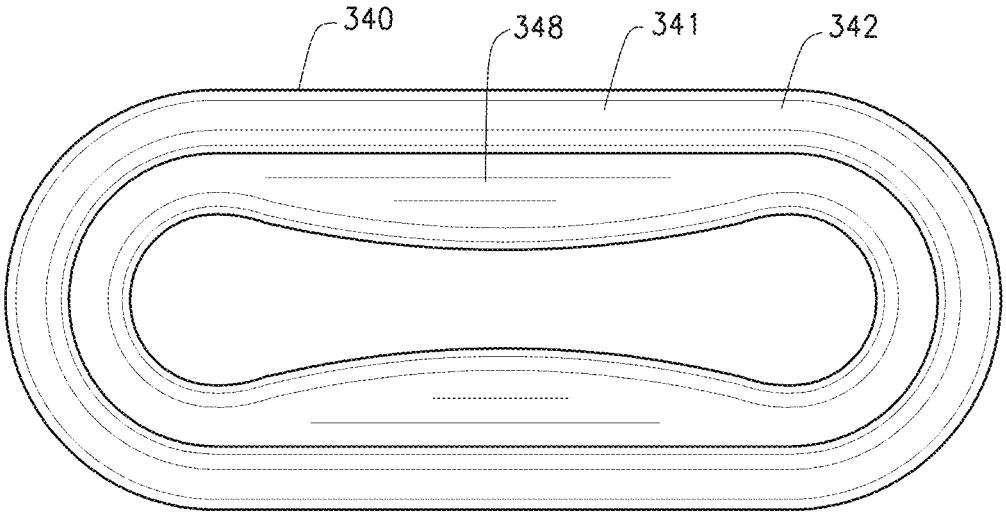
Figure 14A:
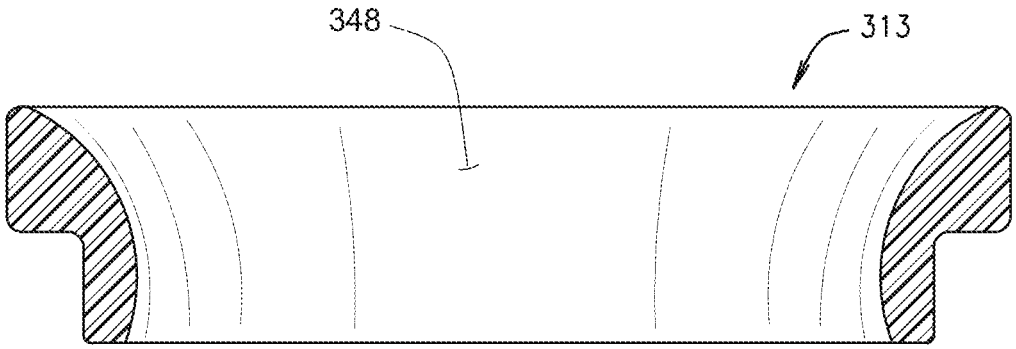
FIGS. 14A and 14B are cross-sectional views of the nozzle insert taken along lines 14A-14A and 14B-14B, respectively, of FIG. 13A.
Figure 14B:
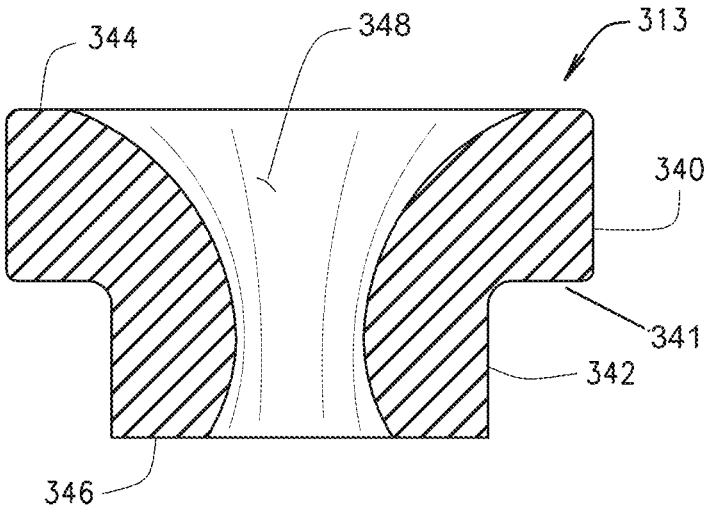

The insert 313 has an upper surface 344 and lower surface 346 which extend inwardly from the upper end of the upper outer surface 340 and the bottom of the lower outer surface 342, respectively. An arced inner surface 348 extends between the inner edges of the upper and lower surfaces 344 and 346. As best seen in FIGS. 12A and 13A, the insert's inner surface 348, and the opening defined by the insert, is also dog-bone shaped, and has outer ends which are generally semi-circular in shape and which are joined by opposed inwardly arcing (convex) surfaces.

Figure 8A:
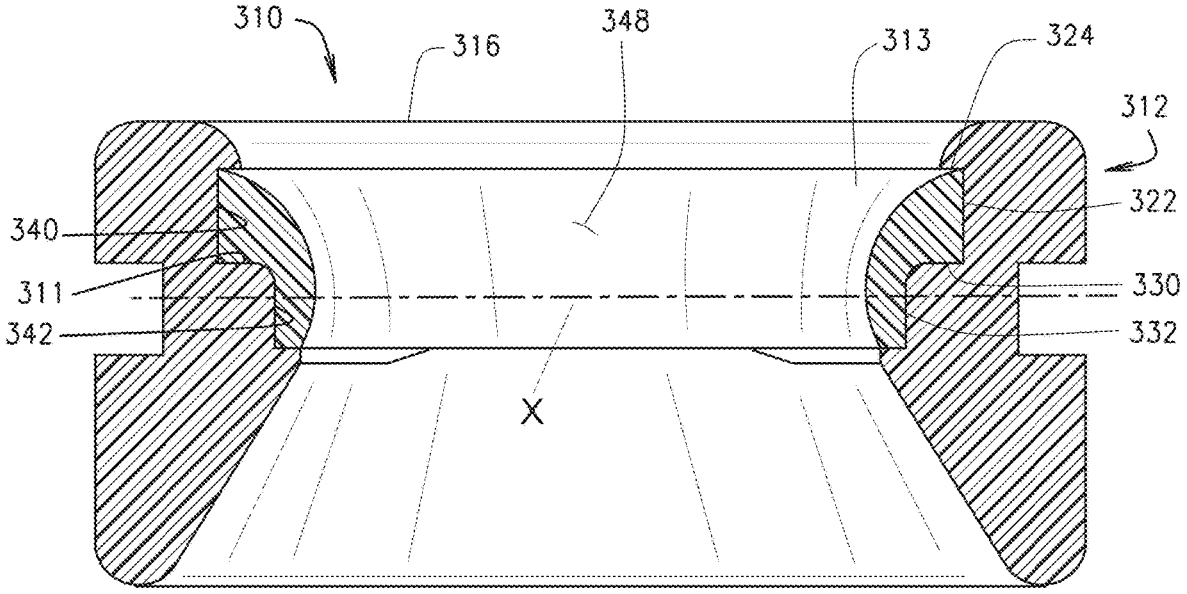
FIGS. 8A and 8B are vertical cross-sectional views of the two-piece nozzle when assembled taken at 90° relative to each other.
Figure 8B:
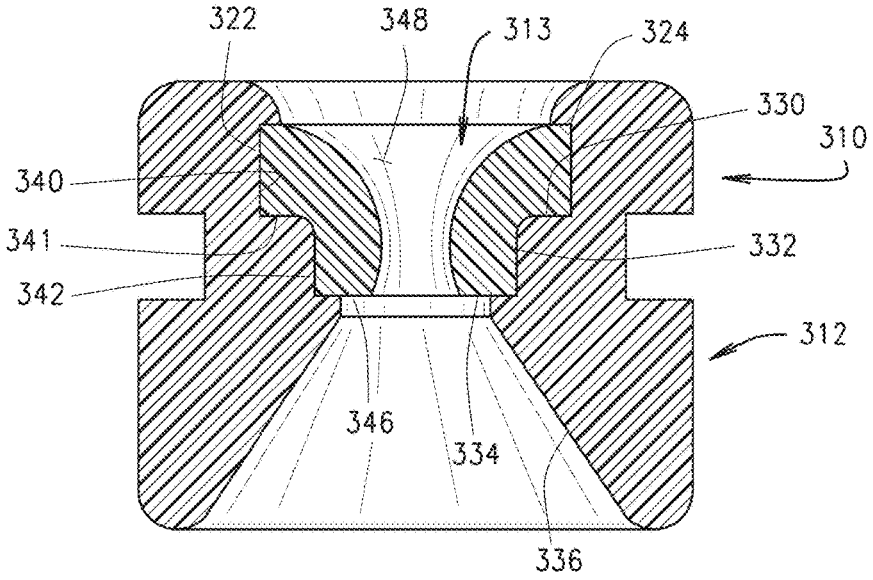

As seen in FIGS. 8A and 8B, the insert upper wall 340 is sized to fit between the insert floor 330 and lip 324, such that the upper portion of the insert 313 is sandwiched between the body floor 330 and lip 324. This interference fit between the insert and body will prevent the insert from moving axially relative to the body. The insert shoulder 341 is sized, as noted, to correspond to the annular width of the body floor 330, such that the insert lower surface 342 will be adjacent the body central wall 332. The insert lower wall 342 is sized to have a length corresponding to the length of the body central wall 332, such that the bottom surface 346 of the insert 313 rests on the lower floor 334 of the body 312. As seen, the arced or radiused inner surface 348 of the insert forms a smooth transition between the inner edge of the body upper surface 316 and the body lower surface 336.

The insert 313 is preferably press-fit into the body 312. The body 312 is made from a slightly flexible material, such as a plastic or rubber, which will allow for the upper portion of the body 312 to expand as the insert 313 is urged into place in the body 312. Once in place, as seen in FIGS. 8A and 8B, the body upper portion will snap back into place to hold the insert in the body and substantially prevent movement of the insert relative to the body.

By forming the nozzle in two parts, the nozzle can be manufactured from different materials. As noted, the body can be made from a plastic or rubber, whereas the insert can be made from a hard material (such as tool steel plated with nickel hardened) which will withstand the friction of the cable over the insert to prevent cold welding of the cable to the nozzle. Alternatively, the nozzle insert can be formed from a softer material (such as a rubber, plastic, or soft metal) and then have a hard coating at least on the inner surface 348 which will meet the hardness requirements. If desired, the entire insert can be coated with the hard coating. The arced shape of the insert inner surface 348 substantially ensures that virtually all the friction forces of the cable are borne by the inner surface, and to substantially prevent the cable from contacting the inner surface of the body (which is made from a softer material than the insert). Hence, the inner surfaces of the body 312 do not need to be provided with a hard coating.

In operation, the dog bone configuration of the nozzle opening (i.e., an opening with a constricted center) holds the cable on one side of the cable drum 16 in the retractor housing until the drum wrap build up on the inside of the drum forces the cable to flip to the opposite side of the nozzle. During retraction of the cable onto the drum, the nozzle 210, 310 causes the cable to completely fill one side of the drum 16 before flipping to the opposite side of the drum, and thus, the cable switches back and forth between opposite sides of the drum until the drum is filled. This keeps the cable almost level on the drum and allows for the full cable to retract onto the drum.

As various changes could be made in the above constructions without departing from the scope of the invention, it is intended that all matter contained in the above description or shown in the accompanying drawings shall be interpreted as illustrative and not in a limiting sense. For example, the outer surface, or footprint, of the nozzle is shown to have an oblong flattened circle shape. However, the outer surface of the body could define any desired shape, as long as the body is shaped to be mounted in the housing of the retractable.

The invention claimed is:

1. A nozzle for a retractable fall arrest device, said nozzle defining a passage, said passage configured to have a cable of the retractable fall arrest device supporting a user passing through said nozzle, said passage extends through the nozzle between a top surface and a bottom surface of the nozzle and defines a passage axis; said passage having an elongate entrance and an elongate exit; said passage defining a constricted portion, a horizontal cross-section of said constricted portion extending substantially perpendicular to said passage axis, said constricted portion having opposed end sections and a middle section; said end sections of said constricted portion defining a width greater than a width of the middle section of said constricted portion; wherein the width of the middle section of said constricted portion is less than a width of at least one of said entrance and exit to said passage; and wherein a perimeter of said passage defines a plane which intersects said passage axis at an angle greater than zero.

2. The nozzle of claim 1 wherein edges of said end sections of said constricted portion of said passage define a substantially semicircular arc and wherein edges of said middle section define an inwardly directed arc.

3. The nozzle of claim 1 wherein the entrance and exit to said passage at the top and bottom of said nozzle are generally in the shape of a flattened oval or elongated circle.

4. The nozzle of claim 1 wherein said constricted portion is between said entrance and exit to said passage.

5. The nozzle of claim 1 wherein at least an upper portion or upper edge of said constricted portion of said passage comprises a material capable of withstanding frictional forces of a cable sliding across said upper surface to prevent cold welding of the cable to the nozzle.

6. The nozzle of claim 1 wherein said nozzle is a one-piece unitary nozzle comprising a hollow body; the body including an inner peripheral flange which divides the body passage into an upper portion and a lower portion, said flange defining said constricted portion of said passage.

7. The nozzle of claim 6 wherein said upper portion of said passage includes a side wall; said side wall being a generally straight side wall.

8. The nozzle of claim 7 wherein said side wall of said upper portion is generally parallel to said passage axis.

9. The nozzle of claim 7 wherein said side wall of said upper portion is recessed relative to an inner edge of said top surface of said body.

10. The nozzle of claim 6 wherein said lower portion of said passage is defined by a wall which slopes from an edge of said constricted portion of said passage to a bottom inner edge of said passage.

11. The nozzle of claim 6 wherein junctions between said top and bottom surfaces of said nozzle and said passage are curved, to present a continuous and substantially smooth surface to a cable which may contact the junction between the body and the passage.

12. The nozzle of claim 1 wherein said nozzle comprises a nozzle body and a separate insert which is received in said body, said insert defining said constricted portion of said passage.

13. The nozzle of claim 12 wherein said nozzle insert has an inner surface which defines said constricted portion of said passage; said inner surface comprising a material capable of withstanding frictional forces of a cable sliding across said upper surface to prevent cold welding of the cable to the nozzle.

14. The nozzle of claim 12:

wherein said nozzle body comprises an upper portion defined in part by an upper inner wall, a central portion defined in part by a central inner wall, and a lower portion defined in part by a lower wall, a first floor between said upper portion and said central portion, and a second floor between said central portion and said lower portion; said central portion wall being set inwardly from said upper portion wall; said lower portion wall sloping outwardly and downwardly from an inner edge of said second floor to a bottom of said nozzle body; and wherein said nozzle insert comprises an upper outer wall shaped complementarily to said nozzle body upper inner wall, a lower outer wall shaped complementarily to said nozzle body central wall, a shoulder between said upper and lower outer walls, and said inner surface; said shoulder being sized and shaped to sit on said nozzle body first floor; said inner surface extending from a top of said insert to a bottom of said insert.

15. The nozzle of claim 14 wherein said nozzle body comprises a lip extending inwardly from a top of said upper inner surface over said first floor; said insert upper outer wall having a height corresponding substantially to the height of said body upper inner surface; such that an upper portion of said insert is sandwiched between said body first floor and said body lip.

* * * * *